US006371429B1

(12) United States Patent
Gillespie

(10) Patent No.: US 6,371,429 B1
(45) **Date of Patent: *Apr. 16, 2002**

(54) STABILIZATION OF OBJECTS

(76) Inventor: Daniel Gillespie, 209 Chatham St., Lynn, MA (US) 01902

( * ) Notice: Subject to any disclaimer, the term of this patent is extended or adjusted under 35 U.S.C. 154(b) by 229 days.

(21) Appl. No.: 08/799,898

(22) Filed: Feb. 13, 1997

(51) Int. Cl.[7] ..... A47F 5/00

(52) U.S. Cl. ..... 248/354.1; 248/286.1; 248/511

(58) Field of Search ..... 248/279.1, 284.1, 248/286.1, 354.1, 354.2, 354.3, 511, 514, 515, 539, 519; 47/40.5, 39

(56) References Cited

U.S. PATENT DOCUMENTS 951,319 A * 3/1910 Krum et al. ..... 248/279.1
999,908 A * 8/1911 Tatro ..... 248/354.1
1,340,273 A * 5/1920 Jones ..... 248/284.1
2,019,789 A * 11/1935 Mahannah ..... 248/279.1
2,731,223 A * 1/1956 Riccio ..... 248/511
3,437,296 A * 4/1969 Hinz ..... 248/38
4,650,427 A * 3/1987 Huchinson ..... 248/354.1
5,188,330 A * 2/1993 Curtis, Jr. ..... 248/519

* cited by examiner

*Primary Examiner*—Anita King
*Assistant Examiner*—Gwendolyn Baxter

(57) ABSTRACT

A method of stabilizing a surface mountable object, such as a Christmas tree, by (a) displacing a positioning member away from the surface, such as a floor, and (b) fixedly attaching the tree on the positioning member away from the floor, with the tree having the same orientation that it would otherwise have if not attached to the positioning member, which has an outwardly extending axis, and the tree is vertically mounted with respect to the axis and the floor, and the positioning member is horizontally placed with respect to the floor.

15 Claims, 5 Drawing Sheets

STABILIZATION OF OBJECTS

BACKGROUND OF THE INVENTION

This invention relates to the stabilization of objects to avoid their accidental upset, and more particularly to the stabilization of decorative devices such as Christmas trees against inadvertent upset.

During many periods of celebration, such as Christmas, it is customary to have decorative devices, such as Christmas trees, which are decorated with lights, ornaments and tinsel. If such a heavily decorated object is accidentally upset, there not only is the danger of breakage of ornaments and damage to the environment, where the device is located, but also, in some cases, there can be a danger of fire or even accident when an occupant of the household trips over the fallen device or is struck by it during the fall. Although the prior fire hazard from the use of lighted candles on Christmas trees has been largely abated by the discontinued use of lighted candles, the presence of electrical wiring can cause not only the possibility of electric shock, but also in the case of a short circuit the possibility of a fire hazard.

In prior attempts to stabilize objects, such as heavily decorated Christmas trees, use has been made of stands that seek to anchor the base of the tree in relation to a ground or floor surface. One example is disclosed in U.S. Pat. No. 4,699,347 for CHRISTMAS TREE STAND by Shirley J. Kuhnley of Monroe, Oreg. in application Ser. No. 866,367, Filed May 23, 1986. The Kuhnley tree stand, for Christmas and other occasions, has a circular base with three legs extending upward in tripod form to an apex where a clamping mechanism is located. A ball is securely held between a base located on top of a socket leg and a clamp top. An elongated member pivots on the socket leg and has a lower end with a spring biased away from the socket leg, forcing the clamp upon the ball. The clamp and the ball are temporarily released by foot pressure on the lower end of the clamp arm to allow alignment of the three. The ball, with an attached tapered mating groove housing, is removably connected to a tree bracket having a tapered plate attached. The tree bracket is laterally curved with protruding spikes formed on its inner surface, and is strapped to the side of the trunk to hold the tree.

The Kuhnley tree stand is not only complex and cumbersome, it does not keep a tree from being accidentally toppled.

Another Christmas Tree Stand is disclosed in U.S. Pat. No. 5,492,301 of Robert J. Hauser, Shreveport, La., in Application Ser. No. 292,936, filed Aug. 18, 1994.

The Hauser Christmas tree stand has a base that rests on a supporting surface. A ball assembly is secured to the base in universally-pivoting swivel by a fixed socket bracket that cooperates with a movable socket bracket. A mount cup is secured to the ball assembly for receiving and mounting the trunk of a Christmas tree. The mount cup and ball assembly can pivot and swivel over 360 degrees to orient the tree vertically regardless of the configuration of the trunk. Accessory leg extensions are adjustable and slidably extendable from the base.

Both the Hauser device and that of Kuhnley, have many disadvantages. They do not prevent the tree from falling over either because the stand does not provide sufficient support, or because of an accidental encounter with the tree. Even where the stands have elongated legs that bear against the floor surface, it is still impossible to prevent accidental toppling when there is inadvertent encounter with the tree, for example by small children and pets. The tree presents an attractive nuisance because of the dangling ornaments and the bright and often flashing lights. Children and pets often pull or grab the tree, and in some cases even climb on it, causing the tree to fall over because of poor vertical stabilization.

Another consequence of a fallen tree is the possible occurrence of extensive damage to household goods and presents under the tree.

Poor stabilization can also present injuries to people and pets, and also can cause fire due to electrical lights being displaced by the falling of the tree.

Accordingly, it is an object of the invention to provide enhanced stabilization for decorative objects, such as Christmas trees. A related object is to reduce the consequence of having a fallen tree cause extensive damage to household goods and presents under the tree.

A further object of the invention is to reduce the extent to which poor stabilization can also present injuries to people and pets, and also can cause fire due to electrical lights being displaced by the falling of the tree.

SUMMARY OF THE INVENTION

In accomplishing the foregoing and related objects, the invention provides for convenient stabilization by which decorative devices, such as Christmas trees, can be supported and maintained in a secure, vertical position.

In accordance with a general aspect of the invention, apparatus is provided for stabilizing a surface mountable object by a mechanism, fixedly positionable with respect to the surface, for mounting the object, including a member on the mounting mechanism for fixedly attaching the object.

The mounting mechanism has an axis extending outwardly from the fixed position and the object is vertically mountable with respect to the axis. The mounting can place the object, such as a Christmas tree in a perpendicular position with respect to the axis.

The mounting mechanism can be formed by a housing with a telescoping inner member with an attached pivotable extension is attached to said inner member, terminating in structure, such as a flange, for retaining the object.

A clamp can secure the object against the flange, and the mounting mechanism is secured to a panel by screw fasteners.

In a method of the invention for stabilizing a surface mountable object the steps (a) fixedly positioning a mounting mechanism for object with respect to the surface; and (b) fixedly attaching the object on the mounting means.

The mounting means has an axis extending outwardly from the fixed position, and the object is vertically mounted, for example perpendicularly, with respect to the axis of the mounting mechanism.

Where the object is a Christmas tree, it is mounted on the fixedly positioned mounting mechanism formed by a housing with a telescoping and adjustable inner member, with the mounting mechanism screwed into a wall plane, such as a baseboard, window sill or frame , or even the wall itself.

Where a pivotable extension is attached to the inner member, the method further includes the step of adjusting the pivotable extension, and where the extension terminates in a retention device, the method further includes the step of retaining the object by clamping it against a flange.

In a method of the invention for manufacturing apparatus for stabilizing a surface mountable object the steps include (a) providing a mounting mechanism that can be fixedly positioned with respect to the surface; and (b) including, on the mounting mechanism, a structure for fixedly attaching the object thereto.

The method includes providing a housing having an axis extending outwardly from the fixable position, with an adjustable, telescoping inner member and a pivotable extension attached to the inner member terminating in a retainer for the object by clamping against a flange.

When used as a Christmas tree stabilizer, a support arm connects between the tree and a solid surface for support. At a wall attachment end of the arm, a swivel-foot can be secured to a window sill, frame, or baseboard with, for example, a set of screws. At the opposite tree end of the unit, there is a swivel attachment with a circular clamp. The clamp bolts together at each side and can be adjusted to fit a wide range of tree diameters.

Rectangular tubing used for the main support arm provides a steady and rigid support for the weight of the tree. The main section of the arm has two pieces, one that slides into the other. At a position where the two pieces come together they are secured together, for example by screws, after the tree has been stabilized.

BRIEF DESCRIPTION OF THE DRAWINGS

Other aspects of the invention will become apparent after considering several illustrative embodiments, taken in conjunction with the drawings, in which.

DETAILED DESCRIPTION

Figure 1A:
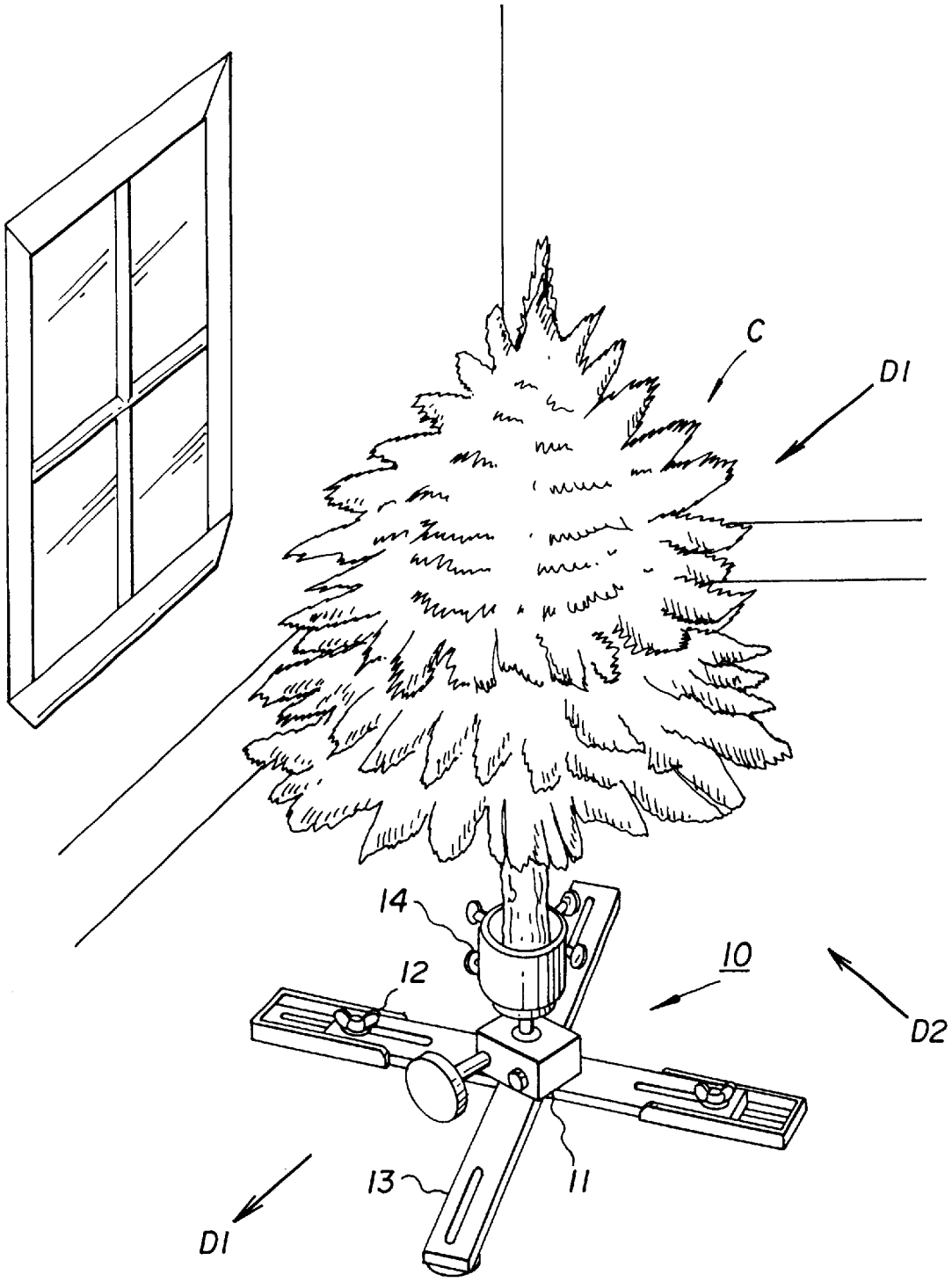
FIG. 1A PRIOR ART
FIG. 1A is a perspective view of a Christmas tree with the unstable mounting that is characteristic of the prior art.

With reference to the drawings, FIG. 1A shows a Christmas tree C being supported by a mount 10 of the prior art. The mount 10 includes a base 11 with angularly separated legs 12 and 13 upon which a support cup 14 for the tree C is positioned. It is apparent that a force in the direction D1 or D2 can cause the tree C to topple, with all of the consequences that accompany an upset device.

Figure 2A:
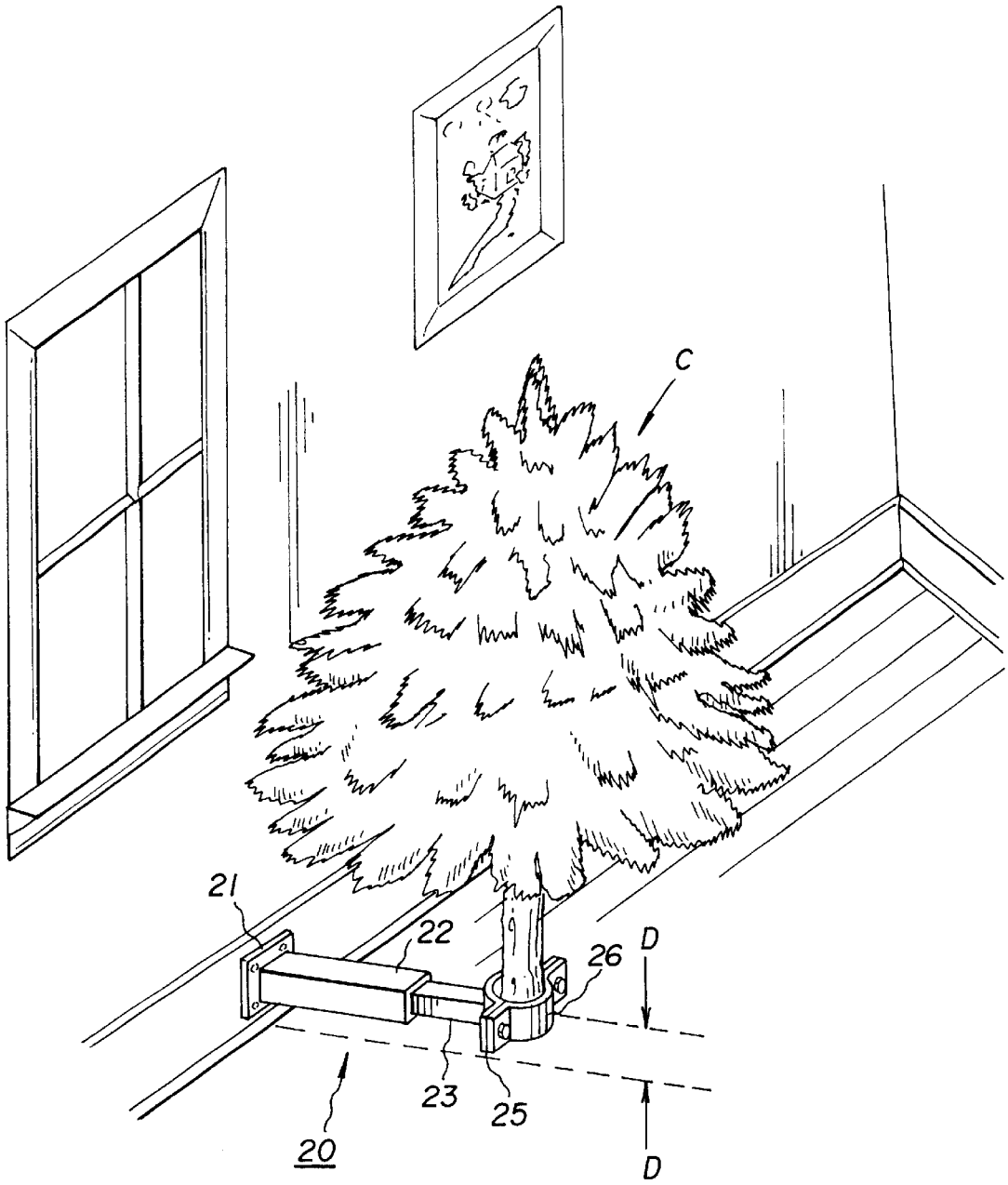
FIG. 2A is a perspective view of a Christmas tree which has been stabilized in accordance with the invention.

The invention overcome the instability of the prior art by use of the stabilizer 20 shown supporting the the Christmas tree C in FIG. 2A at a distance D, which may be zero, above a floor surface. Because of the stabilization provided by the invention, the tree C resists upset.

Turning to the details of the stabilizer 20, a bracket 21 is used to attach the stabilizer 20 to a solid surface, such as a baseboard, with two screws (not shown) through two holes 21-1 and 21-2. A support arm 22, swivels 180 degrees and locks with a screw 22-5 through a hole 21-3 and a threaded hole 21-4 (not visible in FIG. 2B) of the bracket 21. An extendable arm 23 telescopes in and out along a longitudinal axis A from the support arm 22. At the preferred adjusted length, the extended arm 23 and the support arm 22 are secured together by screws 22-1 and 22-2. A swivel arm 24 is pivotable through 180 degrees, and at the preferred angle, locks securely to extending arm 23 with a screw 23-1 through a hole 23-2 to a threaded hole 23-3 (not visible in FIG. 2B).

A flange 25 at the end of the swivel arm 24 is rotatable through 360 degrees and is secured at preferred angle to the swivel arm 24 with a screw 25-1. A tree clamp 26 fastens the tree C (shown in FIG. 2A) to the flange 25, that complements the clamp 26, with screws 26-1 and 26-2 through holes 26-3 that allow the screw 26-1 and 26-2 to access threaded holes 25-2 and 25-3 on the clamp 25.

Figure 2B:
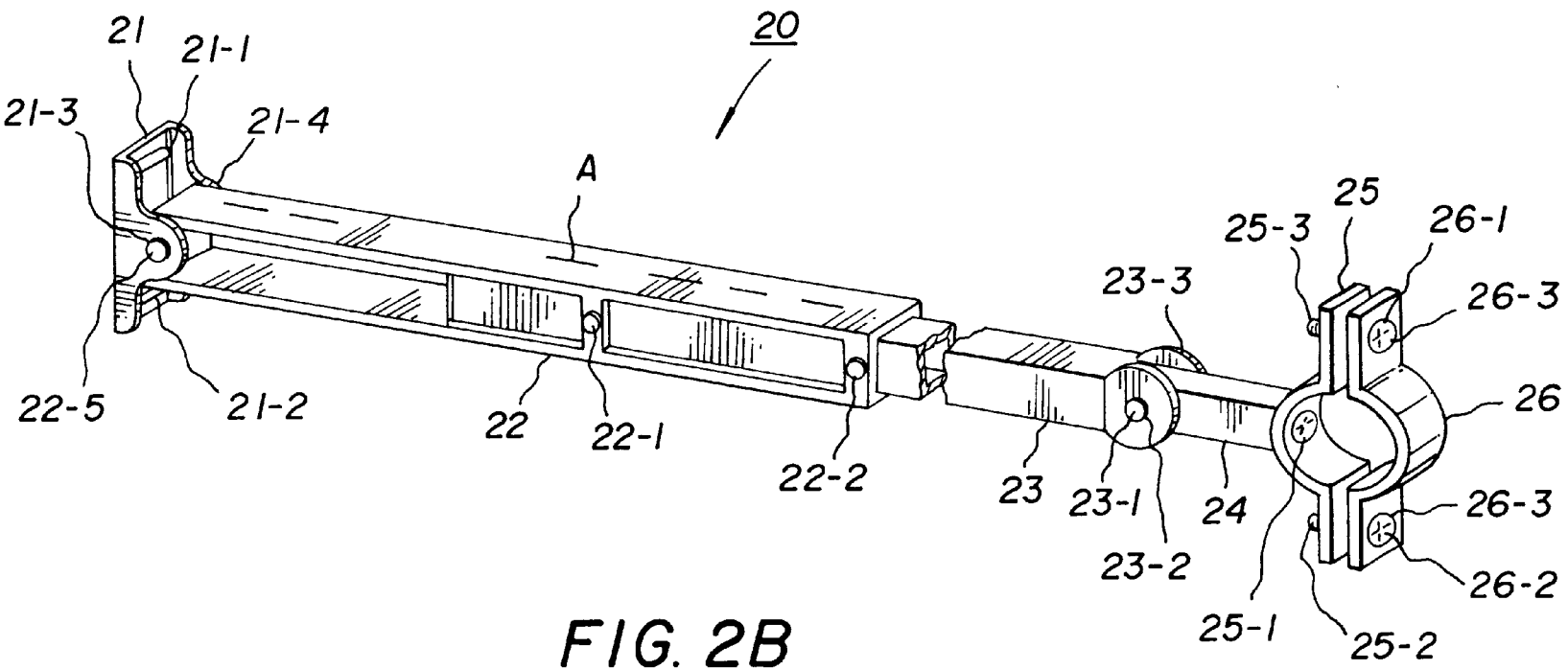
FIG. 2B a perspective view of the stabilizer of the invention shown in FIG. 2A, used to vertically support a Christmas tree with respect to a solid wall surface.
Figure 3A:
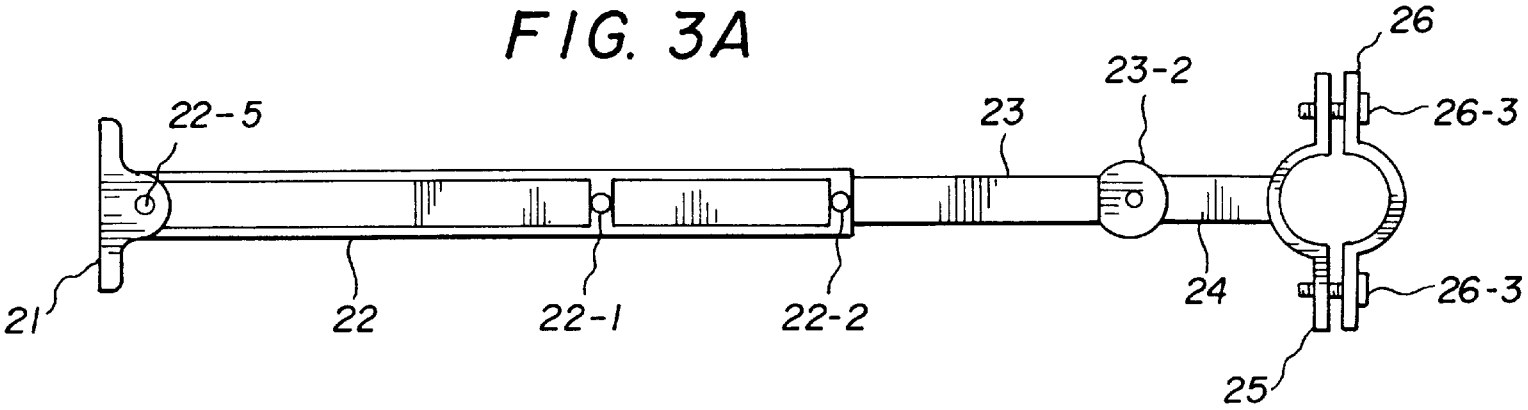
FIG. 3A is a top view of the assembled Christmas Tree Stabilizer.

The stabilizer 20 of FIGS. 2A and 2B is seen from above in FIG. 3A, without the tree C, illustrating the adjustment interval between the flange 25 at the end of the swivel arm 24 and the tree clamp 26, by which the tree C is fastened as shown in FIG. 2A with screws 26-1 and 26-2 that access threaded holes 25-2 and 25-3 on the clamp 25 through holes 26-3. The flange 25 is rotatable through 360 degrees and is secured at preferred angle to the swivel arm 24 with a screw 25-1.

Figure 3B:
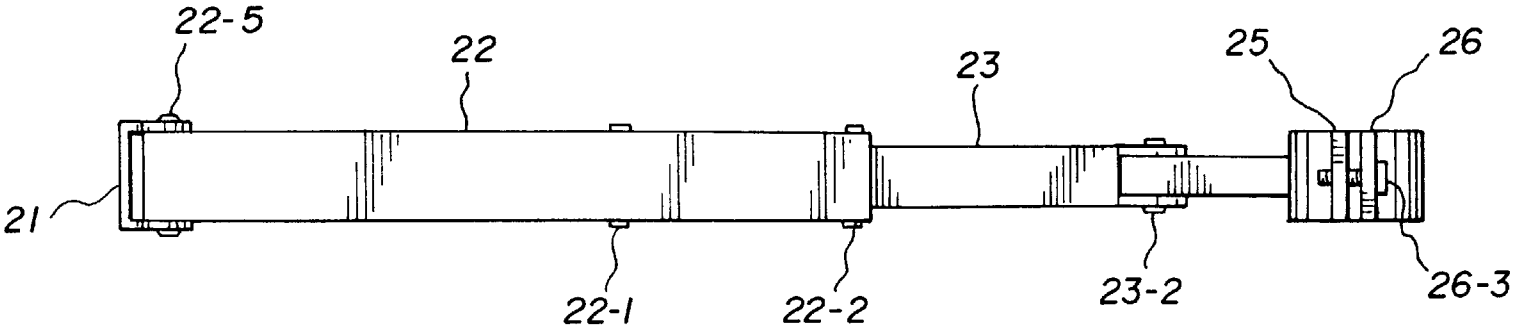
FIG. 3B is a side view of the assembled Christmas Tree Stabilizer.

The stabilizer 20 of FIGS. 2A and 2B is seen from the side in FIG. 3B, without the tree C, further illustrating the adjustment interval between the flange 25 at the end of the swivel arm 24 and the tree clamp 26, by which the tree C is fastened as shown in FIG. 2A with screws 26-1 and 26-2 that access threaded holes 25-2 and 25-3 on the clamp 25 through holes 26-3.

Figure 4:
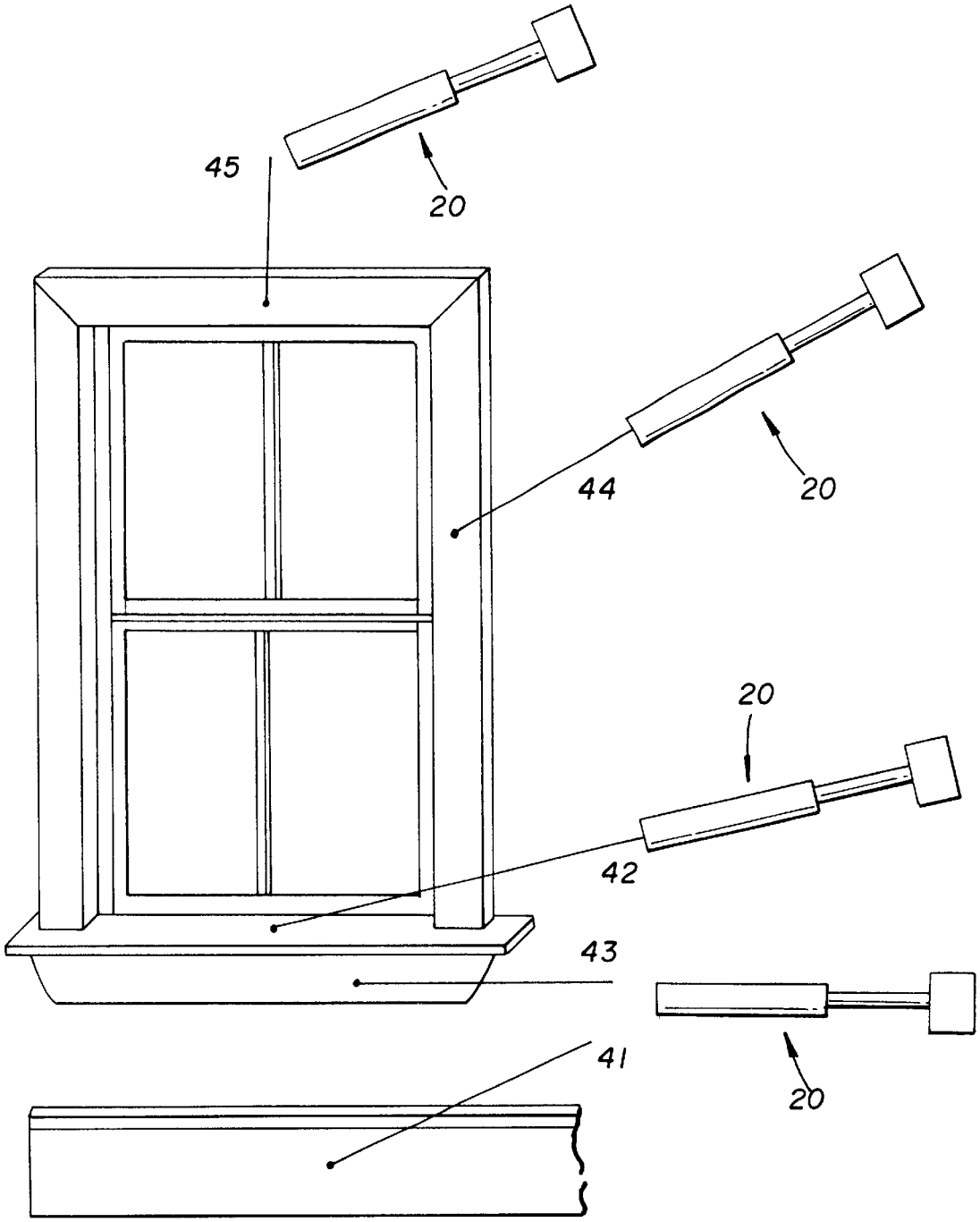
FIG. 4 illustrates various wall mounting positions for the Christmas tree stabilizer of the invention.

In addition to the baseboard 41 shown in FIG. 4 for the mounting of the stabilizer 20 of FIG. 2A, FIG. 4 illustrates various other wall mounting positions for the Christmas tree stabilizer of the invention. Accordingly the stabilizer 20 can be mounted on the window sill 42, on the base 43 of the sill 42, on the side 44 of the window frame, or on the top 45 of the window frame. In addition, by using anchor bolts (not shown) the stabilizer can be mounted on the wall itself. In fact any convenient mounting location may be used.

It will be understood that the foregoing detailed description is illustratively only and that numerous adaptations and modifications of the invention may be made without departing from the spirit and scope of the invention as defined by the appended claims.

What is claimed:

1. A stabilized Christmas tree supported vertically above a floor, at a distance that can approach zero, comprising:

(a) a single bracket for attachment to a solid surface above the floor, (b) a single support arm which can swivel and is locked on said bracket, (c) a single extendable arm which telescopes in and out of said support arm, (d) a fastener for securing said extendable arm and said support arm at a preferred adjusted length, (e) a swivel arm that can pivot and is locked at a preferred angle to said extended arm, (f) a rotatable flange at the end of said swivel arm and is secured at a preferred angle thereto and (g) a tree clamp, complementing said flange, for fastening said tree to said flange.

2. A stabilized Christmas tree as defined in claim 1 wherein screws are inserted through holes in said clamp to access threaded holes on said flange and support arm extends horizontally above said floor.

3. A stabilized Christmas tree as defined in claim 1 wherein said bracket is mounted on a surface selected from the class consisting of baseboards, window frames and walls.

4. Apparatus as defined in claim 1 for stabilizing said Christmas tree, further including means for fixedly attaching said bracket to said solid surface.

5. Apparatus as defined in claim 4 wherein said support arm has an axis extending outwardly from said solid surface and said Christmas tree is vertically mounted with respect to said axis and said floor.

6. Apparatus as defined in claim 5 wherein said Christmas tree is perpendicularly positioned with respect to said axis.

7. Apparatus as defined in claim 4 wherein said Christmas tree is fixedly attached to said tree clamp.

8. Apparatus as defined in claim 4 said means for fixedly attaching said bracket is secured by screw fasteners.

9. A method of stabilizing a tree, which comprises the steps of:

(a) attaching a single bracket to a solid surface above a floor, (b) locking a single support arm, which can swivel, on said bracket, (c) telescoping a single extendable arm in and out of said support arm, (d) securing said extendable arm and said support arm at a preferred adjusted length, (e) locking a swivel arm, that can pivot, at a preferred angle to said extended arm, (f) securing a rotatable flange at the end of said swivel arm at a preferred angle thereto and (g) fastening said tree to said flange by a tree clamp, complementing said flange.

10. The method as defined in claim 9 including the step of vertically mounting said tree with respect to said floor and horizontally positioning said single support arm with respect to said floor.

11. The method as defined in claim 9 wherein said tree is perpendicularly positioned with respect to said floor.

12. The method as defined in claim 11 wherein said positioning is of a Christmas tree.

13. The method as defined in claim 9 further including the step of adjusting said inner member.

14. The method as defined in claim 13 further including the step of adjusting said extendable arm.

15. The method as defined in claim 14 further including the step of adjusting the clamping said tree against said flange.

* * * * *